US005673823A

United States Patent [19]

Hanks et al.

[11] Patent Number: 5,673,823

[45] Date of Patent: Oct. 7, 1997

[54] COMPACT BOTTOM FEED CONTAINER

[75] Inventors: Dallas A. Hanks, Orem; D. Scott Hanks, Pleasant Grove, both of Utah

[73] Assignee: Blue Cow, Inc., Provo, Utah

[21] Appl. No.: 701,084

[22] Filed: Aug. 21, 1996

Related U.S. Application Data

[60] Provisional application No. 60/002,545 Aug. 21, 1995.

[51] Int. Cl. [6] ..... B67D 5/06

[52] U.S. Cl. ..... 222/185.1

[58] Field of Search ..... 222/185.1

[56] References Cited

U.S. PATENT DOCUMENTS

| | | | |
|---|---|---|---|
| 3,837,533 | 9/1974 | Splan | 222/185.1 X |
| 4,746,034 | 5/1988 | Ata et al. | 222/185.1 X |
| 4,911,334 | 3/1990 | Kedzierski | 222/185.1 |
| 5,037,005 | 8/1991 | Appleby et al. | 222/185.1 X |
| 5,096,096 | 3/1992 | Calaunan | 222/185.1 |
| 5,139,173 | 8/1992 | Evinger | 222/185.1 |
| 5,370,277 | 12/1994 | Wallis | 222/185.1 X |
| 5,385,272 | 1/1995 | Aoun | 222/185.1 |
| 5,421,488 | 6/1995 | Ehrbar | 222/185 |

*Primary Examiner*—Kevin P. Shaver
*Attorney, Agent, or Firm*—Broadbent, Hulse, Pierce & Pate

[57] ABSTRACT

A compact bottom feed container is disclosed in one embodiment of the present invention as including a housing member having a top panel, a bottom panel, a front panel, a back panel, and two opposing side panels. A support assembly preferably engages the housing member to provide a free-standing dispenser. Disposed in relation to the internal surface area of the panels, an internal cavity may be formed having an internal surface area sufficient for housing a dry or fluid substance therein. In design, the opening is preferably disposed in relation to the housing member such that to provide a means for side-viewing the dispensing flow of the dry or fluid substance in the internal cavity of the housing member and through the internal periphery of the opening. Preferably, the bottom panel of the housing member is formed having a first end, a second end, and an intermediate portion disposed therebetween. In preferred structure, the intermediate portion of the bottom panel is formed providing a substantially declining surface. In addition, the intermediate portion may comprise two opposing sides formed having a radial curvature which is substantially disposed in fluid communication with the contiguous side panels of the housing member. Further, to assist in providing an effortless flow of the fluid substance housed within the internal cavity to the opening, the second end of the bottom panel is preferably formed having a radial curvature substantially disposed in fluid communication with the contiguous portion of the outer periphery of the opening, thus providing a means for directly feeding the dry or fluid substance into the opening without incorporating any shelves or dead corners.

20 Claims, 4 Drawing Sheets

COMPACT BOTTOM FEED CONTAINER

BACKGROUND

1. Related Applications

This application is a continuation of our co-pending provisional application Ser. No. 60/002,545, filed on Aug. 21, 1995 for NATURALLY INVERTED OR BOTTOM DISPENSING CONTAINER.

2. The Field of the Invention

This invention relates to dispensing containers, and, more particularly, to a novel compact bottom feed container designed to house and dispense dry and viscous fluid substances and wherein the present invention comprises no structural shelves or dead corners.

3. The Background Art

Dry or viscous fluid substances generally utilized for commercial consumption or application are traditionally disposed in rigid glass or plastic containers having a dimensional size suitable for being hand held and/or easily manipulated by a user. For example, prior art containers were developed by those skilled in the art comprising a means for dispensing a fluid substance through an opening preferably disposed contiguous to the upper portion or at the top of a container (e.g., "top-opening containers"). A wide variety of fluid substances such as, ketchup, honey, shampoo, lotions and other cosmetic products, motor oil, etc. may be dispensed from top-opening containers of the prior art.

In operation, top-opening containers of the prior art are typically inverted in such a manner so as to dispose the opening of the container over an area to which the fluid substance is to be disbursed. Accordingly, the liquid contents of prior art top-opening containers normally begin to flow to an inverted top opening under the influence of gravity and/or from pressure applied to the soft-walls of the container thereby encouraging the fluid substance to dispense outward therefrom. Although prior art top-opening containers have been used commercially for many years and have acquired several commercial applications, top-opening containers of the prior art embody several inherent disadvantages.

One meaningful disadvantage of top-opening containers of the prior art is that the opening of the container assembly must generally be substantially inverted to provide a conduit wherethrough the liquid contents of the container may be dispensed. Furthermore, a user may not only have to invert prior art top-opening containers but, in addition, the container may also require agitation in order to stimulate the liquid contents toward the inverted top opening to provide for dispersion of the fluid substance. While shaking the container to sufficiently agitate the fluid substance, a user will generally have to wait for the liquid contents to flow toward the opening. The inverting, shaking and waiting process typically becomes more time consuming as the quantity of fluid substance within the container diminishes. Thus, there may be a significant waiting period required before the liquid actually begins to flow from the opening of prior art top-opening containers.

In an attempt to reduce the inherent dispersion time delay commonly experienced with prior art top-opening containers, users may endeavor to desperately support the container assembly in an overturned position sufficient to compel the liquid contents to the inverted top opening of the container. Because prior art top-opening containers are traditionally designed to be supported by a flat, bottom end, it is often difficult and typically frustrating to provide a means for supportably standing a container on its top end. Correspondingly, users of prior art top-opening containers may neither have the time nor the patience to wait for every last drop of the fluid substance in the container assembly to be dispensed therefrom. As a result, a portion of the liquid contents of prior art top-opening containers may be frequently wasted, whereby container assemblies are typically discarded not entirely empty.

In addition, the inconvenience caused as a result of the inherent time delay of prior art top-opening containers may encourage a user to begin violently agitating the container in order to accelerate the dispersion of the liquid contents. Once the internal air pressure of the container is sufficient to allow the ready flow of the fluid substance through the opening, the instantaneous dispersion of the liquid contents of the container usually results in an excessive surplus of the liquid contents being dispensed from the container at a generally accelerated rate which may further result in additional waste of the fluid substance.

Attempting to remedy the foregoing disadvantages, those skilled in the art developed prior art soft-walled containers including a substantially tubular body having a conventional opening and associated flip lid disposed at the top and bottom ends of the container. In preferred operation, the openings disposed at both the top and bottom ends provide a means for dispersing the contents of the container from either end as a result of the influence of gravity and/or by applying pressure to the soft-walls of the container to encourage dispersion.

Prior art soft-walled containers including an opening formed at opposing ends of the container assembly, however, have proven somewhat inadequate. In particular, the technique or method of having to persistently invert and agitate the liquid contents within the container assembly in order to encourage the flow of the fluid substance through either the top or bottom openings typically stimulates the introduction of air into the container assembly which may have a detrimental affect on the liquid contents therein. Because such interaction can influence the hardening and/or spoilage of the fluid substance within the container, the repeated introduction of air into the interior of the container should generally be avoided. Incidently, the fluid substances which have become hardened and/or spoiled may often produce a means for restricting or clogging the openings of prior art containers. In this regard, restricted openings customarily require cleaning and potential clearing of the opening(s) before further use of prior art containers can be realized. Consistent with the foregoing, with prior art top-opening containers and containers having an opening disposed at opposing ends thereof, the repeated interaction of the fluid substance within the container and the air introduced by way of inverting and agitating the liquid contents of the container, unfortunately, is normally unavoidable.

To avoid the introduction of excessive air into the container assembly of prior art containers, those skilled in the art developed containers comprising a cylindrical body having a large, flat base and a reduced top portion which permits draining of the contents of the container without having to sufficiently tip the container. A pivoting pour spout assembly may be provided at the bottom of the container assembly to direct the flow of the contents exiting the internal housing of the container.

Other dispensing containers have also been developed by those skilled in the art. For example, those skilled in the art developed prior art containers providing a means for fluidizing the contents of a container. Fluidizing containers of the prior art may comprise a closure consisting of four walls having an angular convergence which varies between each wall such that the convergence point of all four walls is generally offset from a central axis so as to form a discharge point. A spacer is typically positioned between an air-permeable material and the interior surface defining the closure to create an air space therebetween and an air inlet. In operation, air usually enters through the air inlet, penetrates the air-permeable material, and fluidizes the contents of the container to improve the flow discharge of the substance from the container.

Although prior art fluidizing containers and dispensing containers which incorporate pour spout assemblies may provide several inherent advantages over prior art top-opening containers and squeezable containers with openings disposed at opposing ends thereof, several significant disadvantages still remain. For example, prior art fluidizing and dispensing containers are typically bulky in dimensional size and usually comprise numerous working parts, whereby becoming inherently cumbersome in view of portability and manufacturing costs.

A further disadvantage of prior art dispensing containers is their inherent inability to efficiently and productively exploit storage space as a result of their innate structural shapes. For example, dispensing containers of the prior art may be formed having a partially or entirely cylindrical or tubular configuration. Accordingly, substantially cylindrical or tubular dispensing containers routinely waste storage or shelf area when stored as a result of their substantially circular edges which are typically incapable of being disposed substantially flush with adjacent substantially circular edges of similar prior art dispensing containers. Comparable in storage capacity, prior art dispensing containers having an arcuate shaped top, bottom, and/or edges typically do not effectively utilize storage space in accordance with the reasons outlined above. Moreover, liquid dispensing containers of the prior art may comprise an asymmetrical configuration, whereas the container assemblies are usually incapable of being stored on both the top and bottom ends. In any event, traditional measures taken to store prior art containers typically consume large storage or shelf areas especially in view of the dimensional size and configuration of prior art dispensing containers. In this regard, fees for storing prior art dispensing containers may be costly.

Another significant disadvantage of prior art containers as described above is the waste created as a result of shelves or "dead corners" which are formed in the body of the container assemblies and, in addition, at or near the closeable opening. Accordingly, prior art containers usually have corners formed in the interior surface of the container which do not facilitate in effortless flow of the fluid substance towards the opening. Such "dead corners" typically require a user to agitate the dry or liquid contents of the container assembly by way of shaking the container in an attempt to displace the fluid substance from the shelves and dead corners generally disposed in the body of the container. Similarly, prior art containers may be angularly disposed in such a manner so that the dry or liquid contents of the container assembly begin flowing towards the opening. Such measures by themselves, however, have proven inadequate. Consequently, shelves or dead corners disposed in the body of prior art containers will, more often that not, retain portions of the fluid substance so that some of the dry or liquid contents are readily discarded with the disposable container and, therefore, wasted.

Another meaningful disadvantage of prior art containers is that they typically require a support stand connected to the container in order to provide a means for sufficiently supporting the container in a free-standing position. Because support stands are usually not formed as an integral part of prior art containers, the support stand is typically formed by a separate process and later attached to prior art containers by some fastening means. Furthermore, non-integral support stands will normally increase the cost and complexity of the container.

Consistent with the foregoing, while the prior art containers disclosed above appear generally suitable for their intended purposes, these containers of the prior art nevertheless leave much to be desired from the standpoint of simplicity of construction, efficiency of operation, and ease of storage. As will be appreciated in the art, economic considerations are significant when dealing with the highly competitive packaging industry, since relatively complicated devices are frequently found to be commercially impractical. Accordingly, even a slight savings in the cost may substantially enhance the commercial appeal of a particular component or assembly when considering issues of mass production.

As illustrated by the number of prior patents and other disclosures, efforts are continuously being made in an attempt to provide a means for more efficiently dispensing all the fluid substance contained within containers. Correspondingly, none of these prior art disclosures suggest the present inventive system or combination of elements for a compact bottom feed container as herein described and claimed.

BRIEF SUMMARY AND OBJECTS OF THE INVENTION

In view of the foregoing, it is a primary object of the present invention to provide a novel compact bottom feed container designed to house and dispense dry or viscous fluid substances by means of providing an effortless flow.

It is also an object of the present invention to provide a compact bottom feed container which structurally comprises no shelves or dead corners in the body of the housing member and, in addition, at or near the bottom feed opening.

Further, it is an object of the present invention to provide a compact bottom feed container which provides a means for emptying the dry or liquid contents of the container without having to invert, agitate, shake, or otherwise manipulate the container in such a manner so as to encourage the flow of the dry or fluid substance within the container through the opening formed at the bottom of the housing member.

Similarly, it is an object of the present invention to provide a compact bottom feed container which is capable of providing a means for dispensing the dry or fluid substance within the housing member, thus avoiding any waste of the dry or liquid contents.

In addition, it is an object of the present invention to provide a compact bottom feed container which is inherently light-weight and conveniently portable.

It is also an object of the present invention to provide a compact bottom feed container which is formed having a structural configuration capable of maximizing storage space.

Further, it is an object of the present invention to provide a compact bottom feed container which is preferably formed as a single, unitary unit comprising a housing member disposed in relation to an integral support assembly which supports the housing member, wherein the support assembly may also be utilized as a handle for manipulating the present invention.

It is a still further object to provide a compact bottom feed container which is capable of being easily supported and/or stored in relation to either the top panel, bottom panel, front panel, back panel and/or the two opposing side panels of the housing member.

Likewise, it is an object of the present invention to provide a compact bottom feed container which enables a user to view the dispersion of the dry or fluid substance disposed within the housing member flow from the opening formed in the front wall contiguous to the bottom panel of the container, without having to tilt or raise the container.

Moreover, it is an object of the present invention to provide a compact bottom feed container which simplifies the fluid dispensing process, comprises few moving parts, and is relatively trouble free in operation.

Consistent with the foregoing objects, and in accordance with the invention as embodied and broadly described herein, a dispenser for dispensing dry or fluid substances is disclosed in one embodiment of the present invention as including a novel compact bottom feed container comprising a housing member providing a means for housing dry or viscous fluid substances. The housing member may also incorporate a support assembly which supportably engages the housing to provide a free-standing dispenser. In preferred design, the housing member includes a front panel, a back panel, a top panel, a bottom panel, and two opposing side panels. Preferably disposed in relation to the panels, an internal cavity is formed within the housing member. The internal cavity is generally formed having an internal periphery which provides an internal surface area sufficient for housing the dry or fluid substance therein.

An opening is preferably formed in a recessed portion of the front panel and disposed contiguous to the bottom panel. Preferably, the opening comprises an internal periphery sufficient for dispensing the contents disposed within the housing member therethrough. In preferred operation, the opening provides a means for side-viewing the dispensing flow of the dry or fluid substance from the internal cavity of the housing member and through the internal periphery of the opening.

The bottom panel of the housing member is preferably formed having a first end, a second end, and an intermediate portion disposed therebetween. In structural configuration, the intermediate portion of the bottom panel is preferably formed providing a substantially declining surface or slope. In addition, the intermediate portion comprises two opposing longitudinal sides having a radial curvature substantially disposed in fluid communication with the contiguous side panels of the housing member to provide a means for facilitating an effortless flow from side panels to the bottom panel and then to the opening. To further assist in providing an effortless flow of the dry or fluid substance from the internal cavity to the opening, the second end of the bottom panel is preferably formed having a radial curvature which is substantially disposed in fluid communication with the contiguous portion of the diameter of the opening, thus providing a means for directly feeding the dry or fluid substance into the opening without the incorporation of shelves or dead corners.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the systems and methods of the present invention, as represented in FIGS. 1 through 5, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
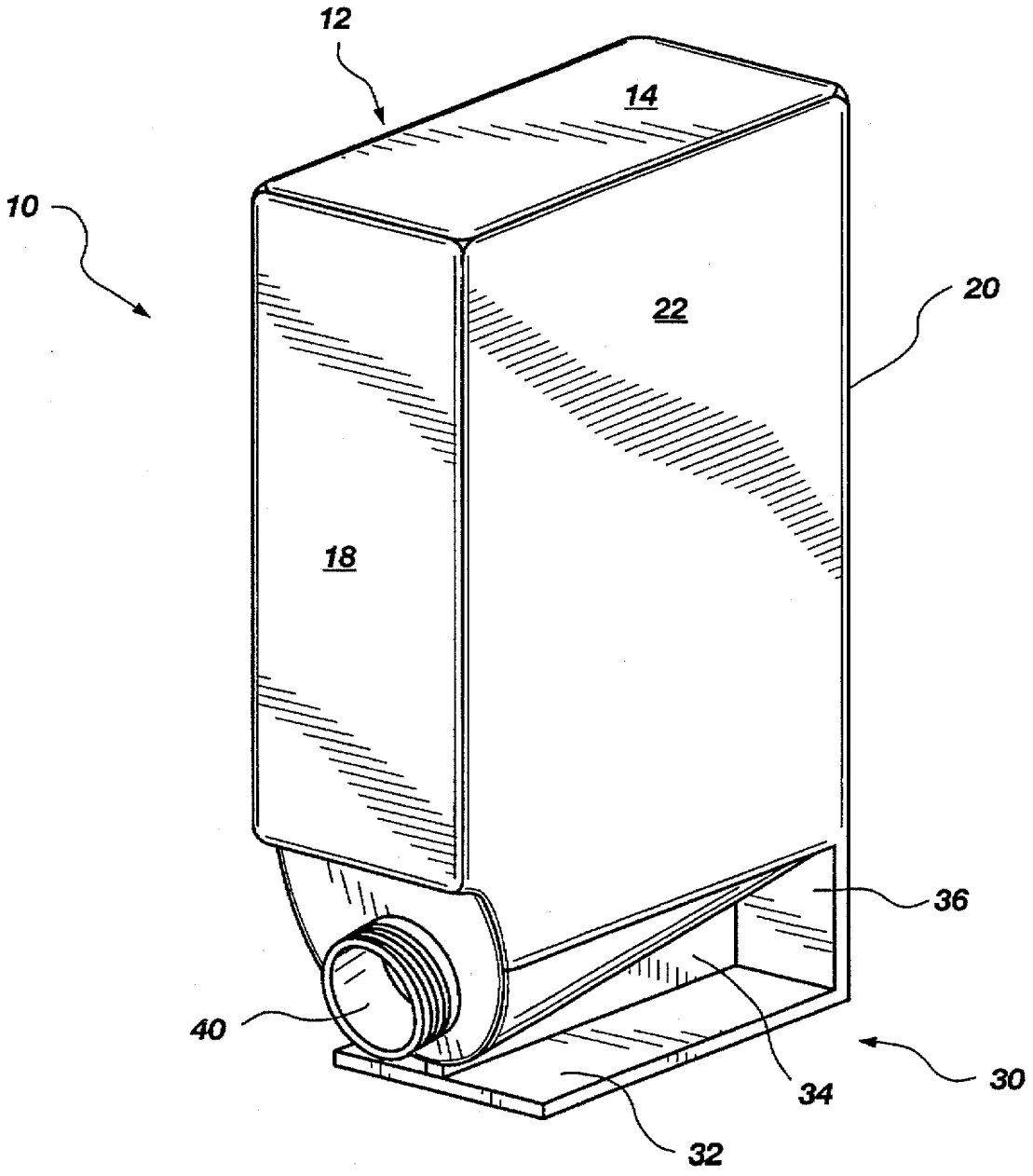
FIG. 1 is a perspective view of one presently preferred embodiment of a compact bottom feed container of the present invention.
Figure 2:
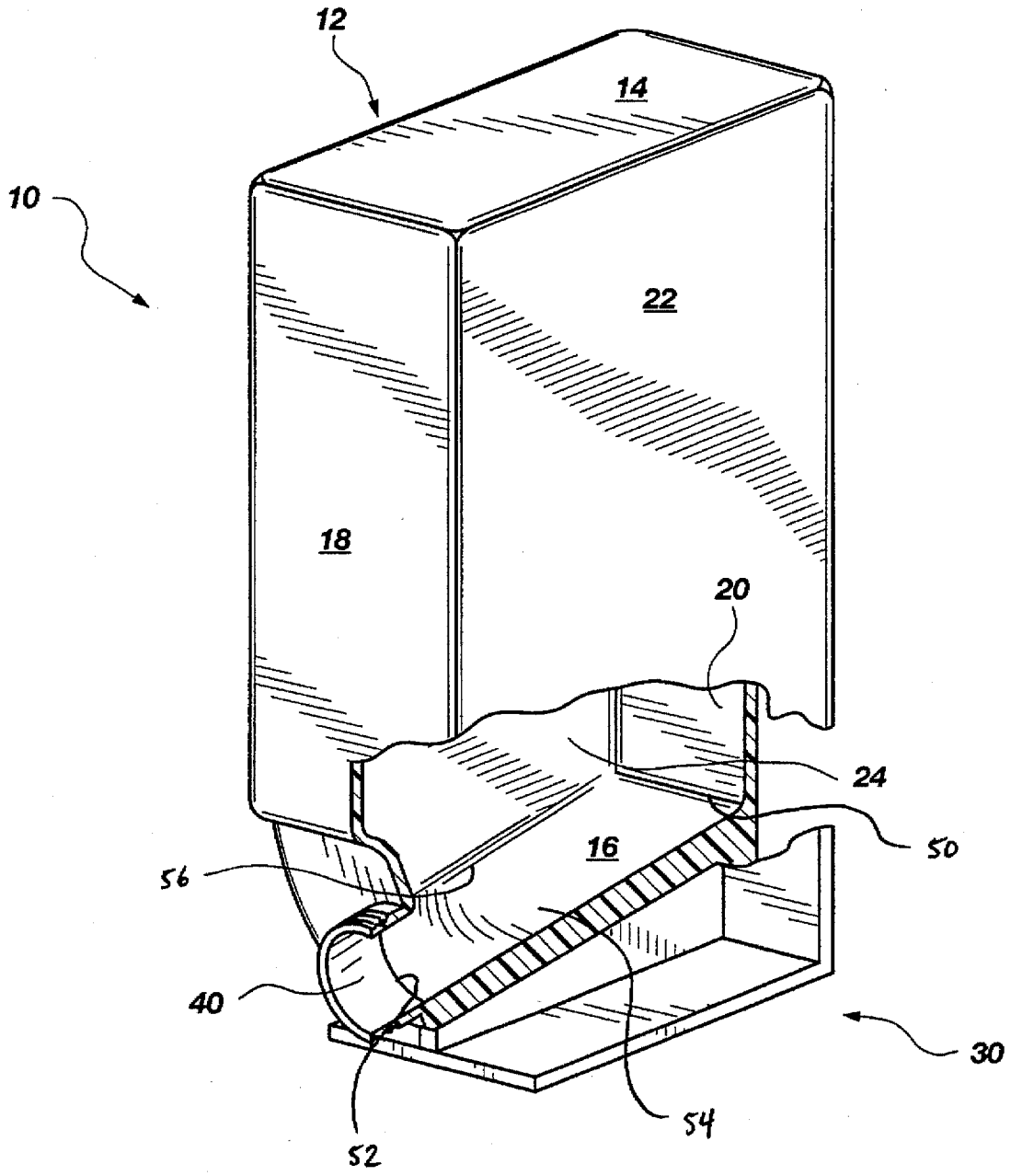
FIG. 2 is a cut-away perspective view of the embodiment of FIG. 1.

One presently preferred embodiment of the present invention, designated generally at 10, is best illustrated in FIGS. 1 and 2. As shown, a compact bottom feed container 10 comprises a housing member 12 having a top panel 14, a bottom panel 16, a front panel 18, a back panel 20, and two opposing side panels 22. In one presently preferred embodiment of the present invention, a support assembly 30 supportably engages the housing member 12 to provide a free-standing dispenser.

Disposed in relation to the internal surface area of the panels 14, 16, 18, 22, an internal cavity 24 may be formed having an internal surface area sufficient for housing a fluid substance therein. An opening 40 is preferably formed in a recessed portion of the front panel 18 and further disposed contiguous the bottom panel 16 of the housing member 12 wherethrough the fluid substance may be dispensed. In design, the opening 40 is preferably disposed in relation to the housing member 12 to provide a means for side-viewing the dispensing flow of the fluid substance from the internal cavity 24 of the housing member 12 and through the internal periphery of the opening 40.

Preferably, the bottom panel 16 of the housing member 12 is formed having a first end 50, a second end 52, and an intermediate portion 54 disposed therebetween. In preferred structure, the intermediate portion 54 of the bottom panel 16 is formed providing a substantially declining surface. In addition, the intermediate portion 54 may comprise two opposing sides 56 formed having a curvature, wherein the opposing sides 56 are substantially disposed in fluid communication with the contiguous side panels 22 of the housing member 12. Additionally, to assist in providing an effortless flow of the fluid substance housed within the internal cavity 24, the second end 52 of the bottom panel 16 may be formed having an inherent curvature which substantially corresponds to a contiguous portion of the internal periphery of the opening 40, thus providing a means for directly feeding the fluid substance into the opening 40 without incorporating any shelves or dead corners.

In preferred construction, the housing member 12 may be formed of any of numerous organic, synthetic or processed materials that are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated. Preferably, the housing member 12 of one presently preferred embodiment of the present invention is blow molded by conventional methods and techniques. It will be readily appreciated by those skilled in the art, however, that a wide variety of other suitable materials which are sufficiently flexible and resilient are possible which are consistent with the spirit and scope of the present invention.

In one presently preferred embodiment of the present invention, the housing member 12 is preferably formed having a substantially rectangular shape. By incorporating a general rectangular configuration, the housing member 12 preferably provides a means for facilitating an efficient use of storage and shelf space, thus providing a space-saving fluid dispenser when disposed in relation to other similar compact bottom feed containers 10 of the present invention.

Although the present invention is illustrated and described in connection with a substantially rectangular housing member 12, those skilled in the art will recognize that various other geometrical configurations are likewise suitable. For example, other geometrical configurations may be incorporated in the design of the housing member 12 such as: substantially cylindrical, substantially triangular, substantially tubular, substantially oblong, etc. It will be readily apparent to those skilled in the art that a variety of geometrical configurations are possible and contemplated herein, so long as the inventive principles set forth herein are incorporated. Wherefore, the use of a generally rectangular configuration is thus by way of illustration only and not by way of limitation.

Referring to FIGS. 1 and 2, the housing member 12 is preferably formed having a substantially uniform thickness and comprising a substantially flat interior and exterior surface. Similarly, the interior and exterior surfaces of the housing member 12 may be formed having a substantially smooth surface, which, as used herein, means that the surfaces are substantially free from roughness.

In one presently preferred embodiment of the present invention, the housing member 12 comprises a top panel 14, a bottom panel 16, a front panel 18, a back panel 20, and two opposing side panels 22. As shown, the front panel 18 and the back panel 20 are preferably disposed longitudinally parallel to each other providing a substantially vertical alignment therebetween. Preferably, the side panels 22 are disposed transverse dimensionally in relation to the front and back panels 18, 20. Disposed in a substantially perpendicular relationship to the front panel 18, the back panel 20, and the two opposing side panels 22, the top panel 14 and the bottom panel 14 are preferably disposed long enough in longitudinal dimension to sufficiently engage the front panel 18, the back panel 20, and the two opposing side panels 22 along an upper portion and a bottom portion of the housing member 12, respectively.

The structural relationship of the various panels 14, 16, 18, 20, 22 provides a means for forming an internal cavity 24. Preferably, the internal cavity 24 comprises an internal periphery sufficient for housing a fluid substance therein, as best illustrated in FIG. 2.

In preferred design, the bottom panel 16 comprises a first end 50, a second end 52, and an intermediate portion 54 disposed therebetween. The intermediate portion 54 is preferably formed having a substantially declining interior surface which may extend from the first end 50 to the second end 52. The intermediate portion 54 of the bottom panel 16 may include two opposing sides 56 which provide an internal surface having a substantially curvilinear configuration. In this regard, the opposing sides 56 of the intermediate portion 54 are generally disposed in fluid communication with the contiguous side panels 22 of the housing member 12. The structural relationship between the intermediate portion 54 of the bottom panel 16 in relation to the side panels 22 preferably provide a means for directly feeding the fluid substance into the opening 40 without incorporating any shelves or dead corners. Moreover, the second end 52 of the bottom panel 16 may be formed having an inherent substantially curvilinear configuration which substantially corresponds to a contiguous curvilinear portion of the internal periphery of the opening 40, thus engageably providing a means for directly feeding the fluid substance into the opening 40 without the incorporation of any shelves or dead corners which inherently promulgate waste. Consistent with the foregoing, the substantially declining interior surface of the bottom panel 16 provides a means for funneling the dry or liquid contents within the internal cavity 24 of the housing member 12 through the opening 40.

In similar structure, the recessed portion of the front panel 18 preferably provides an internal surface having a substantially curvilinear configuration which meets the internal periphery of the opening 40 thereby eliminating any possible shelves or dead corners. As mentioned above, the avoidance of shelves or dead corners generally serves to funnel the dry or liquid contents of the housing member 12 to the opening 40, thus providing easy access to the fluid substance disposed in the compact bottom feed container 10 without having to invert and/or shake the dispensing container. Whereas in preferred operation, the fluid substance disposed within the internal cavity 24 of the housing member 12 will be readily dispensed through the opening 40 under the influence of gravity and/or by way of applying pressure to the opposing side panels 22.

Preferably, the opening 40 is formed having an internal periphery sufficient for dispensing a controlled amount of the fluid substance therethrough. In design, the opening 40 may be formed in the recessed portion of the front panel 18 and disposed contiguous the bottom panel 16. In one presently preferred embodiment of the present invention, the recessed portion of the front panel 18 provides a means for retaining the opening 40 from protruding beyond the substantially rectangular confines of the housing member 12, thereby efficiently utilizing storage or shelf space.

As will be appreciated by those skilled in the art, the opening 40 may be adapted to engage a closeable member, such as, for example, a lid, a cap, nozzle, or the like being operably disposed in relation thereto. In one presently preferred embodiment of the present invention, the opening 40 may be formed having a substantially circular configuration and comprising a protruding lip extending therefrom for removably interfacing a closeable member. For example, a protruding lip formed on the opening 40 may be externally threaded to accept an internally threaded closeable member. As appreciated, those skilled in the art will readily recognize other possible modifications and adaptations which are consistent with the spirit and scope of the present invention.

Figure 3:
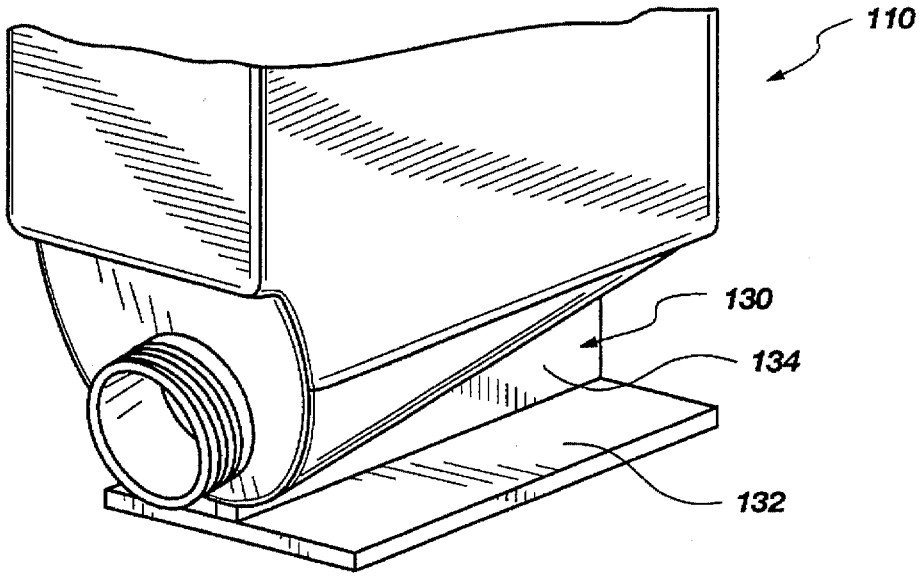
FIG. 3 is an exploded perspective view of one presently preferred embodiment of a support assembly of one presently preferred embodiment of the compact bottom feed container.
Figure 4:
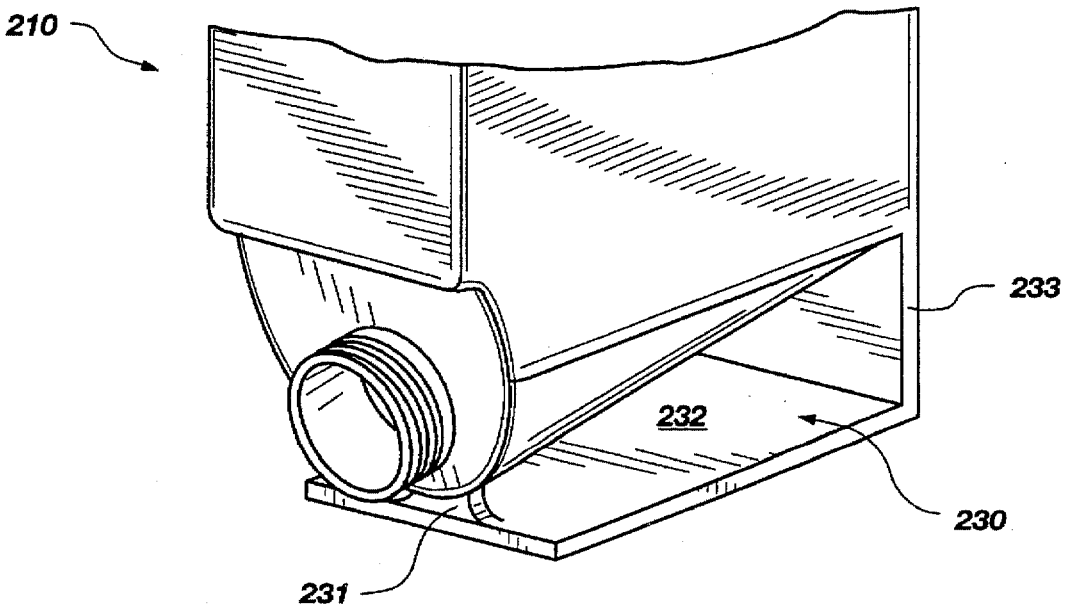
FIG. 4 is an exploded perspective view of an alternate embodiment of the support assembly of one presently preferred embodiment of the compact bottom feed container.

As noted above, a support assembly 30 may supportably engage the housing member 12 to provide a free-standing dispenser disposed in a first position, as illustrated in FIGS. 1, 3 and 4. In preferred construction, the support assembly 30 may be formed of any of numerous organic, synthetic or processed materials that are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated. Preferably, the support assembly 30 is preferably blow molded using conventional methods and techniques. It will be readily appreciated by those skilled in the art, however, that a wide variety of other suitable materials such as, metal or metal alloys, fiberglass, wood, ceramic, graphite and/or other composite materials are possible which are consistent with the spirit and scope of the present invention.

As illustrated in the Figures, the presently preferred embodiment of the present invention comprises various embodiments of a support assembly 30 supportably engaging the housing member 12. Preferably, the supportable relationship between the support assembly 30 and the housing member 12 incorporate a rigid engagement formed therebetween. Similarly, the support assembly 30, 130, 230, 330 and the housing member 12 may be formed as a single, homogeneous unit. It will be readily appreciated by those skilled in the art, however, that the supportable relationship between the support assembly 30 and the housing member 12 may incorporate a releasable engagement structurally disposed therebetween.

In one presently preferred embodiment of the present invention, the support assembly 30 is preferably disposed in relation to the bottom portion of the housing member 12. In this regard, the support assembly 30 may provide a means for supportably engaging the exterior surface of the intermediate portion 54 of the bottom panel 16, as well as the bottom ends of the front panel 18 and the back panel 20.

As illustrated, the support assembly 30 may be formed having a general I-beam configuration, as best shown in FIG. 1. In this configuration, the support assembly 30 comprises a support web 34 having a longitudinal configuration which preferably corresponds to the declining surface of the intermediate portion 54 of the bottom panel 16. In preferred structural design, the support web 34 is vertically disposed between the bottom panel 16 and a support base 32. The support base 32 of the support assembly 30 may be formed having a substantially flat surface sufficient to provide a means for supporting the housing member 12 in a substantially level, horizontally disposed first position. Engaging a distal end of the base support 32, a support leg 36 may be displaced in a substantially vertical position and rigidly disposed in relation to the base support 32 and the back panel 20, thus providing a continuation of the back panel. In an alternate preferred embodiment of the present invention, the support leg 36 of the support assembly 130 is removed whereby the support web 34 is supportably disposed between the bottom panel 16 and the support base, as shown in FIG. 3.

In preferred design of the support assembly 30, a proximate end of the base support 32 preferably does not extend beyond the lower recessed portion of the vertically displaced front panel 18 engageably disposed in relation to the opening 40. A distal end of the base support 32 may be correspondingly disposed in a supportable position that preferably does not extend beyond the vertically displaced back panel 20. Thus, in one presently preferred embodiment of the support assembly 30 of the present invention, the support base 32 consists of a dimensional size being substantially consistent with the dimensional size of the supportable housing member 12, thus providing an overall substantially rectangular configuration to promote storage efficiency.

Referring now to FIG. 4, a second alternate preferred embodiment of the support assembly of the present invention is illustrated as comprising a support assembly 210 having a vertically aligned first support leg 231, a vertically aligned second support leg 233, and a support base 232 supportably disposed therebetween. As illustrated, the first support leg 231 preferably engages the proximate end of the support base 232 and is substantially disposed in relation to the bottom panel 16 of the housing member 12 contiguous the opening 40 formed in the front panel 18. In addition, the second support leg 233 preferably engages the distal end of the support base 232 and is substantially disposed in relation to the back panel 20 of the housing member 12.

A further example (not shown) of the support assembly may comprise a collapsible configuration, similar to the alternate embodiment illustrated in FIG. 4, having a front leg, a support base, and a bendable back leg that is not fixed in relation to the bottom panel of the housing member. The bendable back leg preferably supports the housing member when the back leg is in a vertical extended position engaging the bottom panel. In preferred operation, the bendable back leg may be folded downward (i.e. collapsed) thus disengaging the bottom panel to allow the bottom feed container of the present invention to become more compact.

In accordance with the various embodiments of the support assembly 30, 130, 230 of the present invention, it will be readily appreciated by those skilled in the art that other structures of the support assembly may be constructed in accordance with the inventive principles set forth herein. It is intended, therefore, that the examples provided herein be viewed as exemplary of the principles of the present invention, and not as restrictive to a particular structure for implementing those principles.

Figure 5:
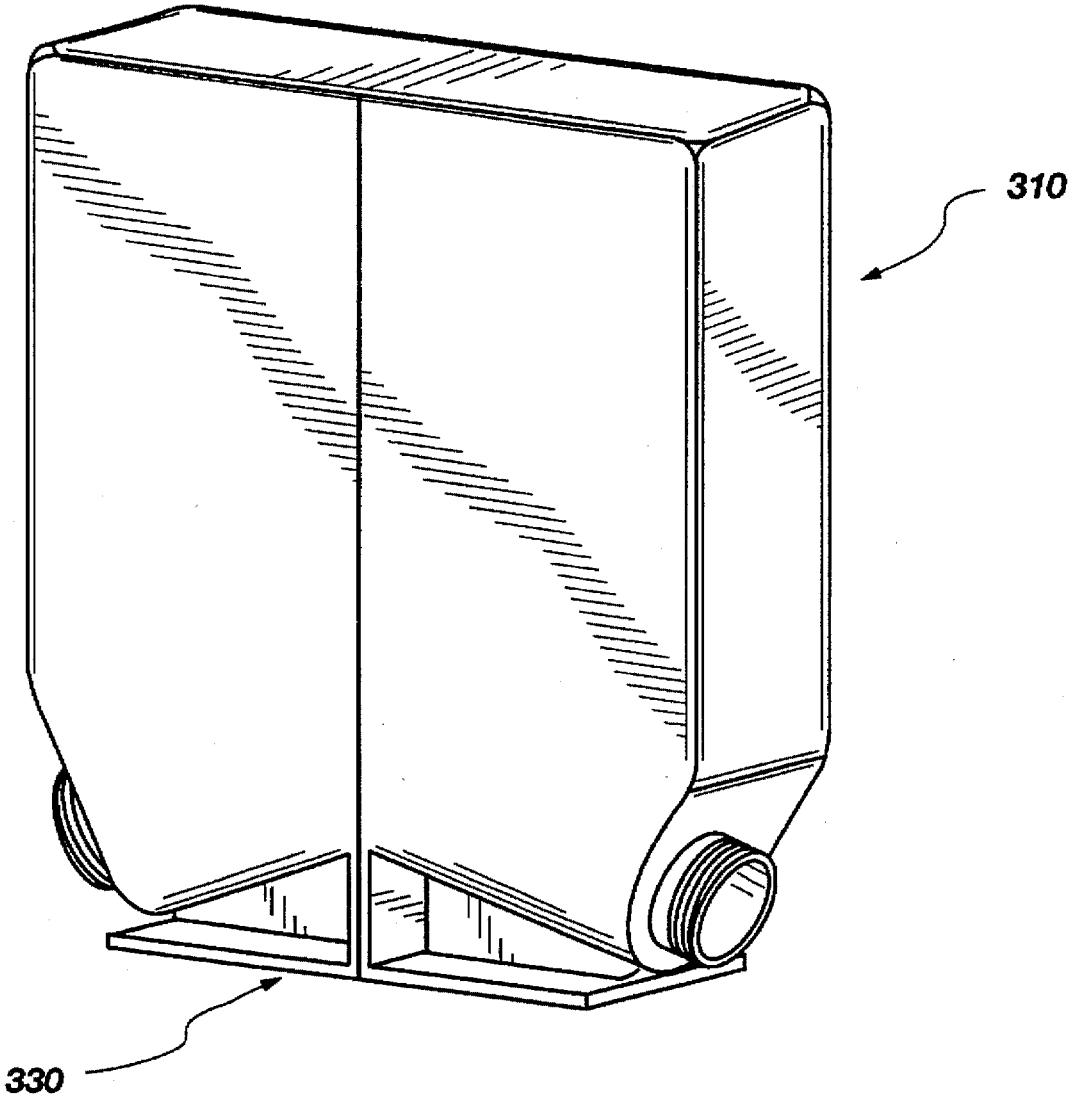
FIG. 5 is a perspective view of an alternate embodiment of the compact bottom feed container illustrating a dual-container design.

Referring now to FIG. 5, an alternative embodiment of the compact bottom feed container 310 comprises a dual-container design. Preferably, the bottom feed container 310 comprises two compact housing members homogeneously molded as a single unit having a common back panel. The features as set forth above in relation to the compact bottom feed container 10 may be incorporated by reference to the dual-container invention 310. For example, the support assembly 330 of the dual container 310 may include, for example, a support assembly having an I-beam configuration.

In addition to the foregoing, the top panel 14 of the housing member 12 preferably comprises a substantially flat exterior surface which may be disposed substantially horizontal when the compact bottom feed container 10 is readily disposed in a first or second supportable position. When the top panel 14 is supportably disposed against a surface, thus providing an inverted opening 40, the top panel 14 preferably provides sufficient structural support to adequately support the housing member 12 in the inverted second position. Whereas when disposing the housing member 12 in the second position for filling the internal cavity 24 with a fluid substance or for purposes of storage, the compact bottom feed container 10 is supportably disposed on the top panel 14. In the second position, the support assembly 30 preferably provides a handle which may serve to assist in manipulating the compact bottom feed container 10 of the present invention when disposed in an inverted orientation.

From the above discussion, it will be appreciated that the present invention provides a compact bottom feed container designed to house and dispense fluid substances by means of an effortless flow. Further, the present invention provides a compact bottom feed container which provides a means for emptying the dry or liquid contents of the container without having to invert, agitate, shake, or otherwise manipulate the container in such a manner so as to encourage the flow of the fluid substance within the container through the opening formed at the bottom of the housing member. Similarly, the apparatus and techniques of the present invention enable a user to view the dispersion of the fluid substance disposed within the housing member from a side-viewable opening, without having to tilt or raise the container.

Unlike prior art devices, the present invention provides a compact bottom feed container structurally comprises no shelves or dead corners within the body of the housing member or, in addition, at or near the opening. Similarly, the present invention is capable of dispensing the fluid substance disposed within the housing member, thus avoiding any waste of the dry or liquid contents. The present invention also provides a compact bottom feed container which is inherently light-weight, conveniently portable, and which is preferably formed having a structural configuration capable of maximizing storage space. Moreover, the present invention is preferably formed as a single, unitary unit comprising a housing member disposed in relation to an integral support assembly which may also be utilized as a handle for manipulating the present invention, whereby the compact bottom feed container of the present invention is capable of being easily supported and/or stored in relation to either the top panel or bottom panel of the housing member. Consistent with the foregoing, the present invention simplifies the fluid dispensing process, comprises few moving parts, and is relatively trouble free in operation.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A dispenser for dispensing a fluid substance, said dispenser comprising:

a housing member including a front panel, a back panel, a top panel, a bottom panel, and two opposing side panels, wherein said housing member comprises an internal cavity having a sufficient internal periphery for housing said fluid substance therein;

an opening having an internal periphery sufficient for dispensing said fluid substance therethrough, said opening formed in a recessed portion of said front panel and disposed contiguous said bottom panel;

said bottom panel having a first end, a second end, and an intermediate portion disposed therebetween, said intermediate portion comprising a substantially declining interior surface extending from said first end to said second end, said second end having an internal surface comprising a curved configuration being substantially disposed in fluid communication with a portion of said internal periphery of said opening; and said intermediate portion of said bottom panel further comprising opposing sides having an internal surface comprising a curved configuration being substantially disposed in fluid communication with said contiguous side panels of said housing member.

2. A dispenser as defined in claim 1 wherein said housing member comprises a substantially rectangular configuration.

3. A dispenser as defined in claim 1 wherein said top panel comprises a substantially flat exterior surface providing means for supportably disposing said housing member thereon.

4. A dispenser as defined in claim 1 wherein said opening provides means for side-viewing a dispensing flow of said fluid substance from said internal cavity of said housing member.

5. A dispenser as defined in claim 1 wherein said internal surface of said intermediate portion of said bottom panel comprises a gradually increasing curvature extending from said first end to said second end, said curvature forming a funneling channel.

6. A dispenser as defined in claim 1 wherein said opposing sides of said internal surface of said intermediate portion of said bottom panel comprises a continuously smooth, arcuate shaped surface engageably disposed in association with said opposing side panels of said housing member thereby providing no dead corners.

7. A dispenser as defined in claim 1 wherein said recessed portion of said front panel comprises a substantially curvilinear shape facilitating no dead corners, said recessed portion providing means for encouraging flow of said fluid substance to said opening.

8. A dispenser as defined in claim 1 further comprising a support assembly.

9. A dispenser as defined in claim 8 wherein said support assembly being disposed in supportable relation with said housing member thereby providing a free-standing dispenser.

10. A dispenser for dispensing a fluid substance, said dispenser comprising:

a substantially rectangular housing member including a front panel, a back panel, and two opposing side panels, wherein said housing member comprises an internal cavity disposed in relation to said panels, said internal cavity having a sufficient internal periphery for housing said fluid substance therein;

an opening having an internal periphery sufficient for dispensing said fluid substance therethrough, said opening formed in a recessed portion of said front panel and disposed contiguous said bottom panel, wherein said opening providing means for side-viewing a dispensing flow of said fluid substance from said internal cavity of said housing member;

said bottom panel having a first end, a second end, and an intermediate portion disposed therebetween, said intermediate portion comprising a substantially declining interior surface extending from said first end to said second end, said second end having an internal surface comprising a curved configuration being substantially disposed in fluid communication with a portion of said internal periphery of said opening to facilitate an effortless flow of said fluid substance through said opening;

said intermediate portion of said bottom panel further comprising opposing sides having an internal surface comprising a curved configuration substantially disposed in fluid communication with said contiguous side panels of said housing member providing means for facilitating an effortless flow of said fluid substance from said intermediate portion to said opening; and a support assembly supportably engaging said housing member providing a free-standing dispenser.

11. A dispenser as defined in claim 10 wherein said top panel comprises a substantially flat exterior surface providing means for supportably disposing said housing member thereon.

12. A dispenser as defined in claim 11 wherein said internal surface of said intermediate portion of said bottom panel comprises a gradually increasing curvature extending from said first end to said second end, said curvature forming a funneling channel.

13. A dispenser as defined in claim 11 wherein said opposing sides of said internal surface of said intermediate portion of said bottom panel comprises a continuously smooth, arcuate shaped surface engageably disposed in association with said opposing side panels of said housing member thereby providing no dead corners.

14. A dispenser as defined in claim 11 wherein said recessed portion of said front panel comprises a substantially curvilinear shape facilitating no dead corners, said recessed portion providing means for encouraging flow of said fluid substance to said opening.

15. A dispenser for dispensing a fluid substance, said dispenser comprising:

a substantially rectangular housing member including a front panel, a back panel, and two opposing side panels, wherein said housing member comprises an internal cavity disposed in relation to said panels, said internal cavity having a sufficient internal periphery for housing said fluid substance therein;

an opening having an internal periphery sufficient for dispensing said fluid substance therethrough, said opening formed in a recessed portion of said front panel and disposed contiguous said bottom panel, wherein said opening providing means for side-viewing a dispensing flow of said fluid substance from said internal cavity of said housing member;

said bottom panel having a first end, a second end, and an intermediate portion disposed therebetween, said intermediate portion comprising a substantially declining interior surface extending from said first end to said second end, said second end having an internal surface comprising a curved configuration being substantially disposed in fluid communication with a portion of said internal periphery of said opening to facilitate an effortless flow of said fluid substance through said opening;

said intermediate portion of said bottom panel further comprising opposing sides having an internal surface comprising a curved configuration substantially disposed in fluid communication with said contiguous side panels of said housing member providing means for facilitating an effortless flow of said fluid substance from said intermediate portion to said opening, said internal surface comprising a gradually increasing curvature extending from said first end to said second end, said curvature forming a funneling channel;

a support assembly integrally formed in relation to said housing member, said support assembly providing means for supportably engaging said housing member providing a free-standing dispenser in a first position; and said top panel of said housing member having a substantially flat exterior surface providing means for supportably disposing said housing member in a second position.

16. A dispenser as defined in claim 15 wherein said opposing sides of said internal surface of said intermediate portion of said bottom panel comprises a continuously smooth, arcuate shaped surface engageably disposed in association with said opposing side panels of said housing member thereby providing no dead corners.

17. A dispenser as defined in claim 15 wherein said recessed portion of said front panel comprises a substantially curvilinear shape facilitating no dead corners, said recessed portion providing means for encouraging flow of said fluid substance to said opening.

18. A dispenser as defined in claim 15 wherein said support assembly comprises a first support leg and a second opposing support leg, said first and second legs engageably disposed in spaced-apart relation with a support base and said bottom panel of said housing member.

19. A dispenser as defined in claim 15 wherein said support assembly comprises an I-beam configuration including a support base and a web vertically disposed between said bottom panel and said support base.

20. A dispenser as defined in claim 19 wherein said support assembly further comprises a support leg engageably disposed in association with said support base of said support assembly and said back panel of said housing member.

* * * * *